US005381072A

United States Patent [19]

Tanabe

[11] Patent Number: 5,381,072

[45] Date of Patent: Jan. 10, 1995

[54] LINEAR ACCELERATOR WITH IMPROVED INPUT CAVITY STRUCTURE AND INCLUDING TAPERED DRIFT TUBES

[75] Inventor: Eiji Tanabe, Cupertino, Calif.

[73] Assignee: Varian Associates, Inc., Palo Alto, Calif.

[21] Appl. No.: 846,498

[22] Filed: Feb. 25, 1992

[51] Int. Cl.[6] ..... H05H 9/04

[52] U.S. Cl. ..... 315/5.41; 315/505; 315/5.51; 313/360.1

[58] Field of Search ..... 315/5.41, 5.42, 5.51, 315/5.52; 313/359.1, 360.1; 328/227, 233

[56] References Cited

U.S. PATENT DOCUMENTS

| | | | |
|---|---|---|---|
| 3,011,087 | 11/1961 | Jeppson et al. | 315/5.51 X |
| 3,234,426 | 2/1966 | Heil | 315/5.51 X |
| 3,383,545 | 5/1968 | Heil | 315/5.52 X |
| 3,546,524 | 12/1970 | Stark et al. | 315/5.41 |
| 4,006,422 | 2/1977 | Schriber | 315/5.41 X |
| 4,594,530 | 6/1986 | Aucouturier et al. | 315/5.41 |
| 4,651,057 | 3/1987 | Vetomi et al. | 315/5.41 |
| 4,988,919 | 1/1991 | Tanabe et al. | 315/5.41 |
| 5,029,259 | 7/1991 | Nishihara | 315/5.41 |
| 5,039,910 | 8/1991 | Moriguchi et al. | 315/5.41 |

FOREIGN PATENT DOCUMENTS

| | | | |
|---|---|---|---|
| 448198 | 4/1948 | Canada | 333/228 |
| 196913 | 10/1986 | European Pat. Off. | H05H 9/04 |
| 76700 | 3/1989 | Japan | 328/233 |
| 2081005 | 10/1986 | United Kingdom . | |

OTHER PUBLICATIONS

Filatov et al, "Radical Focusing of Electrons in a biperiodic slow-wave structure with high acceleration rate" 2348 Soviet Physics, Technical Physics 31 (1986) Apr., No. 4, pp. 464–465.

Earley et al., "Rapidly Tuned Buncher Structure for the Los Alamos Proton Storage Ring" 8100 IEEE Transactions of Neculear Science, Vo. NS-20 (1983), Aug., No. 4, pp. 3511–3113.

Huang, Y. and J. Xie, "Measures to Alleviate the Back Bombardment Effect of Thermionic R.F. Electron Gun."; Proceedings of IEEE Particle Accelerator Conf.; 6–9 May 1991; vol. 4, pp. 2017–2019.

*Primary Examiner*—Benny T. Lee

*Attorney, Agent, or Firm*—Bella Fishman

[57] ABSTRACT

A standing wave type of microwave linear particle accelerator (40) has a sequence of microwave cavities (42), (43), (44), operated in the standing wave mode, with drift tube conduits (31), (32), (33), between them to permit the passage of a beam of charged particles which are accelerated by the electric fields in each cavity. The first cavity (42) into which the particles enter has a conduit (30) comprising a drift region connected to the particle entrance port (2), outlined by a re-entrant nose (3) extending into the first cavity (42). The drift tube conduit (31) between the first and second cavities (42, 43) has a tapered interior, and the diameter at the upstream end is less than the diameter of the conduit (30) in the re-entrant nose (3) of the first cavity (42). This structure significantly reduces the back bombardment of particles moving backward through the port (2), and increases the efficiency of particle focusing and bunching in the first cavity (42).

4 Claims, 2 Drawing Sheets

LINEAR ACCELERATOR WITH IMPROVED INPUT CAVITY STRUCTURE AND INCLUDING TAPERED DRIFT TUBES

BACKGROUND OF THE INVENTION

1. Field of the Invention

This invention is related generally to the field of linear particle accelerators, and more particularly, to the field of microwave linear accelerators of the standing wave type for producing beams of electrons and other charged particles.

2. Description of Background Art

Microwave linear accelerators of the standing wave type have been constructed having a series of microwave cavity resonators coupled together and successively disposed along the beam for accelerating the beam of charged particles to high velocity. The charged particles are injected at relatively low energy into the first cavity at the input end of the accelerator and then accelerated by the microwave field as they pass through the successive cavities.

For the case where the beam is comprised of electrons, the injection is achieved by means of an electron gun located at the input end of the accelerator, comprised of a heated cathode which emits electrons with a distribution of velocities and trajectories. The electrons that are accelerated must be focused and bunched as they enter into the series of cavities. Therefore only a fraction of the particles injected by the electron gun are actually incorporated into the beam produced by the accelerator. It is desirable to maximize this fraction of accepted particles.

Many of the rejected electrons strike the walls of the first cavity. However, some of the rejected electrons are focused and accelerated backward through the input cavity port, and are emitted backward with substantial energies. These electrons can overcome the fields of the electron gun and strike the cathode. This phenomenon is known as "back-bombardment". These back-bombarded electrons cause damage to the cathode material, and can impair the operation of the electron gun. Thus, it is also desirable to minimize the amount of back-bombardment of particles at the input end of the accelerator.

SUMMARY OF THE INVENTION

A linear accelerator of the standing wave type is disclosed in which the first microwave cavity at the input end is designed to minimize the amount of back-bombardment by the rejected particles, and to increase the bunching efficiency and the fraction of particles captured into the accelerated beam. The first cavity is designed to have a re-entrant nose channel at the particle inlet port, so that the beam particles initially enter a drift tube region which forms the interior of the re-entrant nose. The particles then proceed into the first cavity. Those particles that are captured into the beam pass through a second drift tube region into a second cavity, and proceed through the remainder of the accelerator. The second drift tube region is tapered, and the diameter of this region at the upstream end is less than the substantially uniform diameter of the first drift tube region. The back-bombarded particles travel back through the first drift tube region and inlet port, and emerge from the accelerator.

This structure for the first cavity has the advantage of providing a significant reduction in the amount of back-bombardment, compared to conventional cavity structures. The present structure for the first cavity reduces the magnitude of the electric field in the first cavity, and the geometry of the nose tends to defocus the particles traveling backward toward the inlet port. Therefore the number of particles propagated backward and the average energy of these particles is decreased in comparison with previous cavities.

In addition, the present structure provides more gentle bunching of the particles captured into the beam in the first cavity. This effect arises from the fact that the magnitude of the electric field gradients in the first cavity is reduced. With more gentle bunching, the efficiency with which particles are captured into the beam is increased. In short, this structure decreases the number and energy of particles emitted backward from the accelerator, and increases the average accelerated beam.

These advantages, and other features of the invention, will be apparent upon inspection of the following detailed description of the preferred embodiments together with the accompanying drawings.

DETAILED DESCRIPTION OF THE PREFERRED EMBODIMENTS

Figure 1:
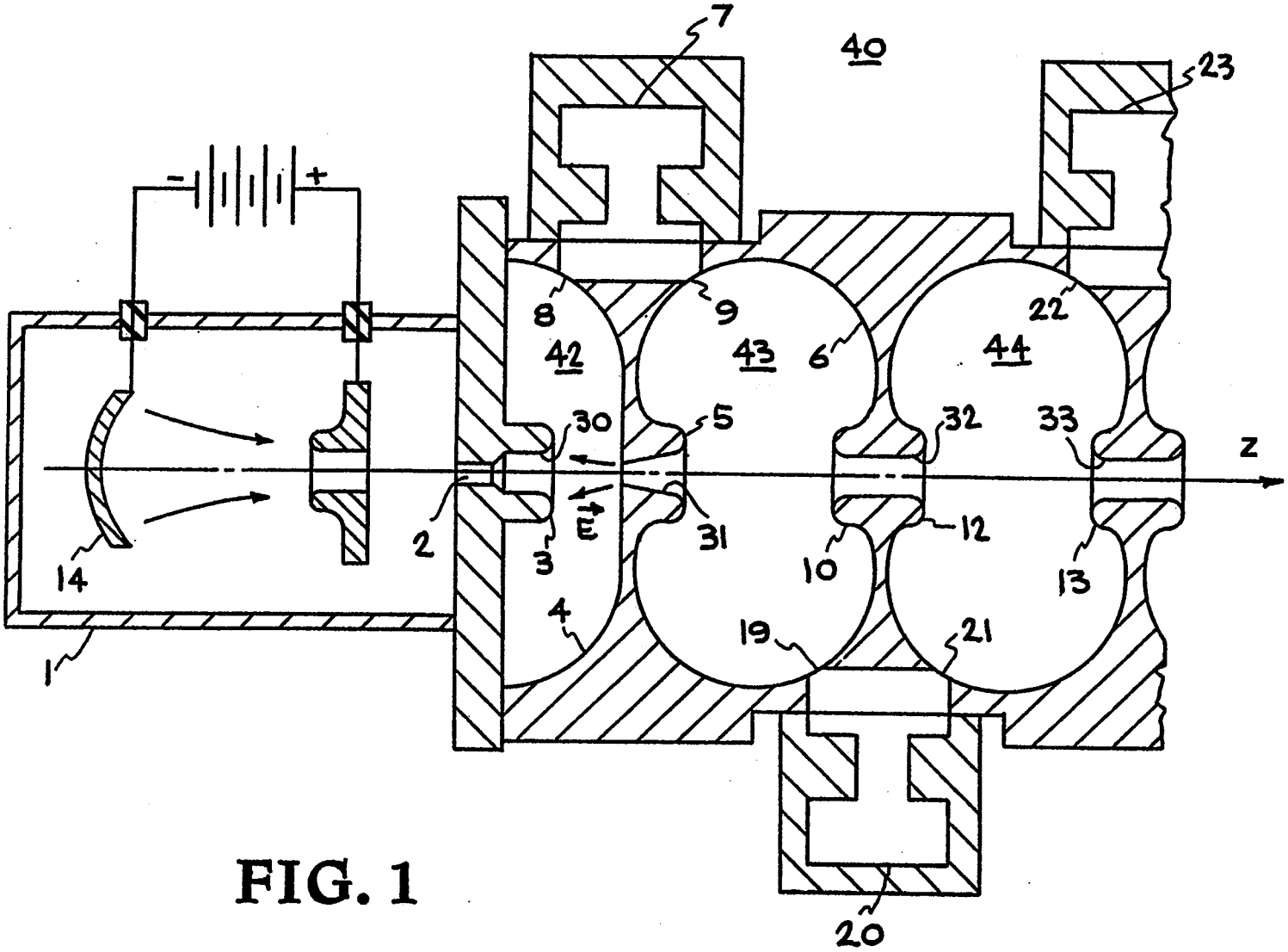
FIG. 1 is a transverse sectional view of a portion of a linear accelerator of the standing wave type according to the present invention, with a beam particle source shown in partially schematic form, where the beam axis lies in the sectional plane.

FIG. 1 shows a microwave linear particle accelerator 40 of the standing wave type according to the present invention. The particle source 1 is indicated in partially schematic diagram form. The particle source comprises an electron gun 14, electrostatic lens 15 and DC voltage source 16. Particles emitted from this source enter the accelerator through the inlet port 2 and pass through the sequence of accelerator cavities 42, 43, 44. Only the first 3 accelerator sections are shown in the drawing. There may be additional sections extending along the beam ax, not shown.

The first microwave cavity 42 is defined by the wall 4. The particles enter through the re-entrant nose 3 extending into the cavity 42. This nose 3 has a drift region 30, which comprises a channel connected to the inlet port 2, and the entering particles pass through this drift region channel 30 into the interior of the cavity 42. The entering particles have a distribution of velocities and trajectories. The electromagnetic fields inside this cavity 42 cause a fraction of these particles to form bunches that are focused and accelerated along the beam axis Z and travel through the exit port 31 into the adjacent cavity 43. This exit port 31 is a drift region in the re-entrant nose 5 extending into the cavity 43. The drift region 31 has a tapered cross section that is narrower at the upstream (i.e. towards the particle sour) end than the substantially uniform cross-section of the drift region 30. The bunches are accelerated in this cavity 43 by the microwave field in a similar manner. In this way, the particle beam continues through the cavity 44, which is connected by the re-entrant noses 10, 12, and 13, having the drift regions 32 and 33, respectively, through which the beam travels between cavities. The bunches are accelerated in each cavity section as the beam passes through the accelerator.

The microwave structure shown in FIG. 1 is of the "side-coupled cavity type". Cavity 7 is located off the beam axis Z and is connected to cavity 42 through the opening 8 and to cavity 43 through opening 9. Cavity 20 is connected to cavity 43 through opening 19, and to cavity 44 through opening 21. Cavity 23 is connected to cavity through opening 22. Thus the cavities are all connected together along the entire length of the accelerator structure, and microwave power is fed to the entire sequence of cavities. The structure is operated in a standing wave mode, such that the electromagnetic fields E in the beam center line cavities 42, 43, and 44, accelerate the beam bunches, and the electromagnetic fields in the side coupling cavities 7, 20, and 23, have no effect on the beam This is known as the "half-pi mode" because the electromagnetic fields between coupled center line cavities and side coupling cavities bear a phase relationship of 90 degrees difference in phase. Therefore the adjacent center line cavities have a 180° phase shift in the fields.

Figure 2:
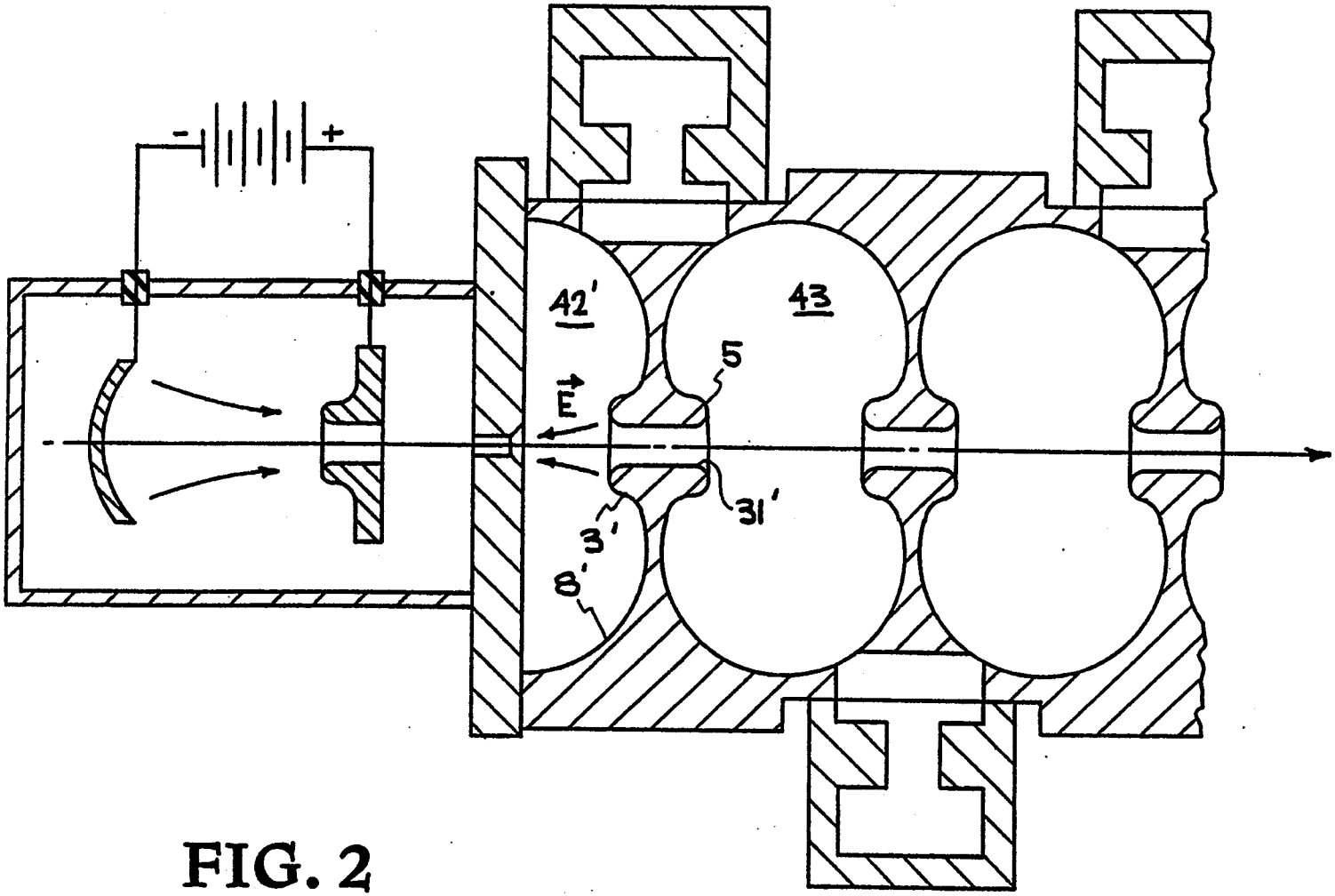
FIG. 2 (PRIOR ART)
FIG. 2 is a transverse sectional view of a portion of a linear accelerator of the standing wave type according to previous conventional designs, with a beam particle source shown in partially schematic form, where the beam axis lies in the sectional plane.

The advantages of the foregoing structure are appreciated by comparing it to the structure shown in FIG. 2, which is the conventional design for this type of accelerator. The difference between these designs will be seen to lie in the locations of the re-entrant noses and drift regions in the first cavity 42'. In the conventional structure of FIG. 2, the re-entrant nose 3' is located on the downstream wall 8' of the first cavity 42', and the drift region 31' of this nose 3' is also the drift region of the nose 5 extending into the adjacent cavity 43'. This is in contrast to the location and structure of the re-entrant nose 3 of FIG. 1. The geometrical parameters of the re-entrant nose 3' are designed to produce the same cavity resonance frequency as the conventional nose 3.

This improvement in the location of the re-entrant nose 3, and the design of the tapered drift region 31, has a marked effect on the beam particles in the input cavity 42. Since the distance from the tip of the nose 3 to the center of the second cavity 43 is less than the corresponding distances of the conventional structure of FIG. 2, the electric fields in the first cavity 42 can be decreased without degrading the bunching effect. Furthermore, the field configuration as shown in FIG. 1 is such that the particles moving backward along the beam axis toward the inlet port 2 tend to be defocused off the beam axis because of the relative diameters of tile drift regions 30 and 31. In contrast, the particles moving backward in the first cavity 42' of FIG. 2 tend to be focused toward the port. The net effect is that the intensity and energy of the back-bombarding particles is substantially reduced in the present structure.

This result has been confirmed by measuring the drop in the current of the cathode 14 caused by the back-bombarding particles during an electron injection gun pulse. It has been found under typical operating conditions that this improvement can decrease the back bombardment current by at least a factor of two.

In addition, it is found that this improvement in the structure of the input cavity re-entrant nose decreases the energy of the back-bombarding particles. Under typical operating conditions, this decrease may be by a factor of approximately three. Thus, the overall decrease in the power deposited in the cathode 14 (see FIG. 1) from back-bombardment may be at least by a factor of six, under typical operating conditions.

The foregoing description of the invention has been presented for purposes of illustration and description. It is not intended to be exhaustive or to limit the invention to the precise form disclosed, and many modifications and variations are possible in light of the above teaching. The embodiment is chosen and described in order to best explain the principles of the invention and its practical applications to thereby enable others skilled in the art to best utilize the invention in various embodiments and with various modifications as are suitable to the particular use contemplated. It is intended that the spirit and scope of the invention are to be defined by reference to the claims appended hereto.

What is claimed is:

1. A linear accelerator for accelerating a beam of charged particles produced by a charge particle source, said linear accelerator comprising:

(a) an inlet port for directing said charged particles from said source into said linear accelerator, said inlet port having a diameter;

(b) at least first and second center line cavities disposed linearly along an axis, each of said cavities having interior walls and having respective entrance openings and exit openings about said axis, said entrance opening of said first cavity connected to said inlet port;

said entrance opening of said first cavity shaped as a re-entrant nose projecting inwardly toward said interior wall of said first cavity in a direction of said exit opening, said re-entrant nose having a channel passing therethrough, said channel defining a first drift region for said charged particles being injected into said first cavity through said inlet port, said channel having a diameter which is larger than the diameter of said inlet port;

(c) conduit means placed between said first and second cavity and defining a second drift region for conducting said charged particles from said first to said second cavity, said conduit means having first and second opposed ends with first and second apertures respectively, said first and second apertures having first and second diameters, respectively, said first end connected to said exit opening of said first cavity, and said second end connected to said entrance opening of said second cavity, wherein said second diameter of said second aperture is larger than said first diameter of said first aperture, a cross section of said conduit means has a continuous taper between said first and said second end;

(d) microwave power means coupled to said first and second cavities for exciting a standing wave field therein.

2. The linear accelerator according to claim 1, further comprising:

a plurality of additional center line cavities disposed linearly along said axis adjacent to said second center line cavity, each of said additional center line cavities having a respective entrance opening for said charged particles to enter and a respective exit opening for said particles to exit from said corresponding cavity;

a plurality of additional conduit means, each additional conduit means having a corresponding drift region and connecting the entrance opening of a respective additional center line cavity to the exit opening of another said additional center line cavity adjacent thereto, a first additional conduit means connecting the exit opening of said second center line cavity to the entrance opening of said additional center line cavity adjoining thereto, such that said particles travel through a trajectory along said axis from said first center line cavity sequentially through said second center line cavity and said plurality of additional center line cavities and additional conduit means.

3. The linear accelerator according to claim 2, further comprising:

a plurality of side coupling cavities positioned off of said axis and coupled into said center line cavities, each of said side coupling cavities having two mutually opposing coupling openings, and each of said side coupling cavities is respectively coupled between an adjacent pair of said center line cavities such that microwave power flows through said openings between said side coupling cavities and said center line cavities.

4. The linear accelerator according to claim 3, wherein said standing wave field is in a half-pi mode.

* * * * *